United States Patent [19]

Becker

[11] 4,024,814

[45] May 24, 1977

[54] TRANSFER DRUM IN SHEET-FED ROTARY PRINTING PRESSES

[75] Inventor: Willi Becker, Bammental, Germany

[73] Assignee: Heidelberger Druckmaschinen Aktiengesellschaft, Heidelberg, Germany

[22] Filed: Nov. 3, 1975

[21] Appl. No.: 628,102

[30] Foreign Application Priority Data

Nov. 2, 1974 Germany ..... 2452096

[52] U.S. Cl. ..... 101/410; 271/276; 271/277

[51] Int. Cl.[2] ..... B41F 1/30

[58] Field of Search ..... 101/409–412, 101/246, 230, 415.1, 183; 271/91–93, 276–277; 270/69, 60, 18, 47

[56] References Cited

UNITED STATES PATENTS

| | | | |
|---|---|---|---|
| 3,096,088 | 7/1963 | Young | 101/409 |
| 3,430,946 | 3/1969 | Siebke | 271/277 |

*Primary Examiner*—Edgar S. Burr

*Assistant Examiner*—A. Heinz

*Attorney, Agent, or Firm*—Herbert L. Lerner

[57] ABSTRACT

A sheet-fed rotary printing press includes a transfer drum assembly includes a rotatable transfer drum having a sheet-supporting peripheral surface, a gripper device carried by the transfer drum for gripping the leading edge portion of a sheet being transferred, and a suction device secured to the transfer drum at the end of the peripheral sheet-supporting surface, as viewed in rotary direction of the transfer drum, for gripping the trailing edge portion of the sheet. The suction device includes a plurality of suckers having suction surfaces disposed in the peripheral surface of the transfer drum and formed with respective suction orifices. The suction surfaces have respective centers and the suction orifices are located eccentrically to the centers, respectively, each of the suction orifices being adjustable so as to apply suction force to a sheet at successively varying locations eccentric to the respective suction surface center for tensioning the sheet in a direction opposite to the rotary direction of the transfer drum.

18 Claims, 14 Drawing Figures

Fig. 6
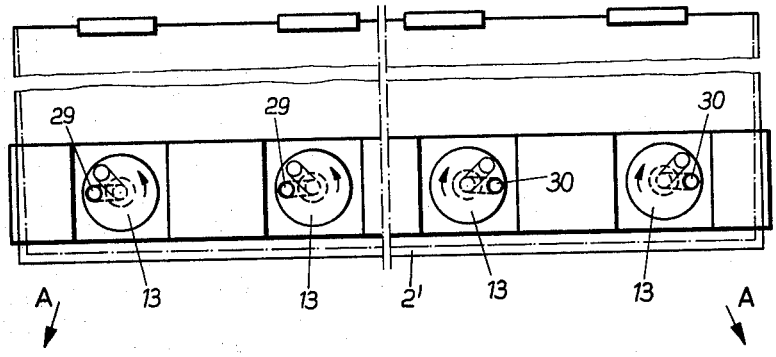
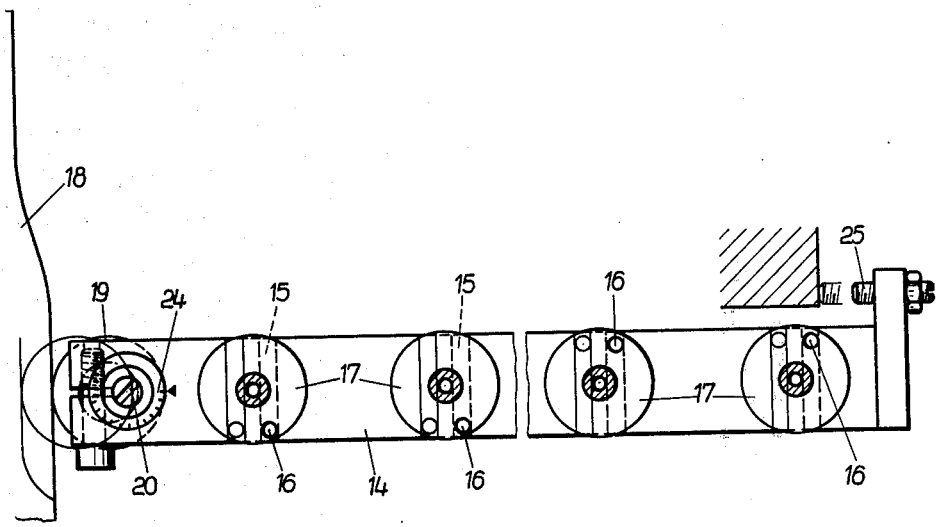
Fig. 7

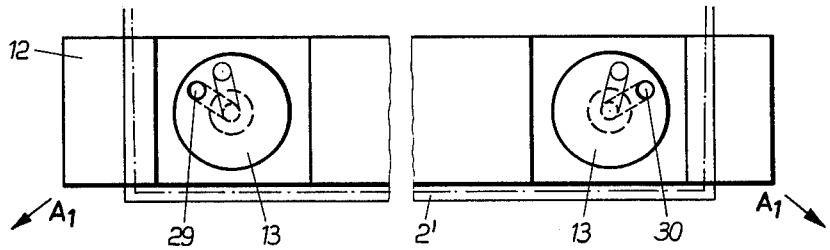
Fig. 8
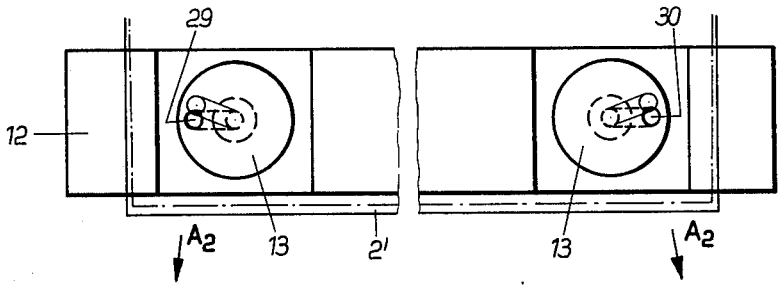
Fig. 9
Fig. 10
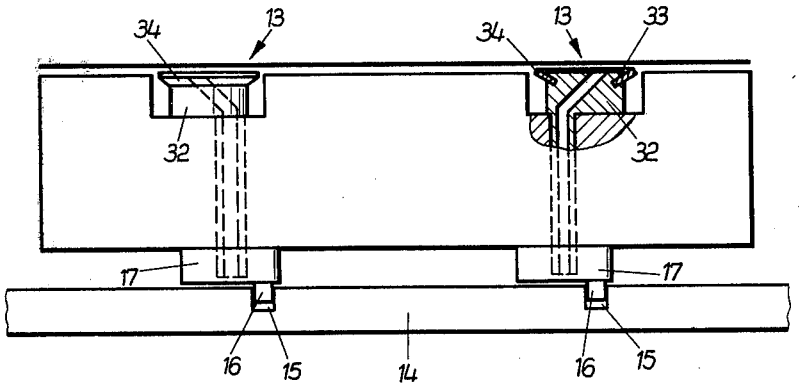

TRANSFER DRUM IN SHEET-FED ROTARY PRINTING PRESSES

The invention relates to a transfer drum assembly in sheet-fed rotary printing presses, especially for printing presses that are convertible from printing on one side of a sheet to printing on both sides of a sheet or perfector printing and vice versa, and particularly to such a transfer drum assembly having a gripper device, gripping the leading edge of the sheet and having a suction device gripping the trailing edge of the sheet, the suction device being secured to the end of the sheet supporting surface on the transfer drum and tensioning the sheet in a direction opposite to the direction of rotation of the drum.

A construction of this general type is disclosed in German Pat. No. 1 155 145, wherein suction heads are used that are prestressed by compression springs. After delivery of the sheets, the suction heads are moved away from the grippers by suction action against i.e. opposing the biasing force of the inner springs. The sheet is thereby supposed to be drawn smooth and tensioned on the transfer drum.

In order to achieve uniform tensioning across the entire width of the sheet, all of the suction heads must exert equal force and travel an equal distance. However, even slight deviations in the resistance of the springs in the suction heads cause one or more of the suction heads to move earlier than the others, or cause them to travel over different distances. This results in the production of uneven tension in the sheet.

This heretofore known construction demands a very high suction action in order for the springs in the suction heads to be able to be compressed. This suction action is much too high for processing thin papers, such as onionskin paper, for example, so that avoidance of damage to the sheets when they are tensioned cannot be assured.

In another heretofore known construction of a sheet transfer drum disclosed in German Pat. No. 1 611 241, a suction device for gripping the trailing edge of the sheet is mounted on a pivoting device. This heretofore known construction has the disadvantage, however, that the sheet can be tensioned only in peripheral direction. Orientation of the sheet transversely to the direction of travel, as is required in actual practice, and processing of stiff sheet material is not possible in that case.

It is accordinly an object of the invention of the instant application to provide a transfer drum assembly in sheet-fed rotary printing presses wherein the foregoing disadvantages of the heretofore known construction of this general type are overcome. More specifically, it is an object of the invention to provide such a transfer drum assembly wherein in a relatively simple manner, a sheet can be subjected to tension in the direction of travel thereof and transversely to the direction of travel thereof, in order to ensure an accurate surrender or transfer of the trailing edge of the sheet both in peripheral register and also in lateral register, especially for printing on both sides of the sheet. The risk of damage to the sheets when processing sheets of thin and soft material must also be eliminated.

With the foregoing and other objects in view, there is provided, in accordance with the invention, in a sheet-fed rotary printing press, a transfer drum assembly comprising a rotatable transfer drum having a sheet-supporting peripheral surface, a gripper device carried by the transfer drum for gripping the leading edge portion of a sheet being transferred, and a suction device secured to the transfer drum at the end of the peripheral sheet-supporting surface, as viewed in rotary direction of the transfer drum, for gripping the trailing edge portion of the sheet, the suction device comprising a plurality of suckers having suction surfaces disposed in the peripheral surface of the transfer drum and formed with respective suction orifice means, the suction surfaces having respective centers and the suction orifice means being located eccentrically to the centers, respectively, each of the suction orifice means being adjustable so as to apply suction force to a sheet at successively varying locations eccentric to the respective suction surface center for tensioning the sheet in a direction opposite to the rotary direction of the transfer drum.

In accordance with another feature of the invention, the eccentric, successively varying locations are in axially outward direction as viewed from the middle of the transfer drum and in direction toward the location at which the trailing edge of the sheet is disposed on the peripheral sheet-supporting surface.

In accordance with a further feature of the invention, the suckers are rotary suckers, and the suction orifice means comprise a respective orifice movable to the varying locations during rotation of the respective rotary suckers.

In accordance with an added feature of the invention, holder means extend across the width of the transfer drum, the rotary suckers being secured to the holder means, control means for imparting rotary movement to the rotary suckers, the suction orifices of the suction orifice means being offset eccentrically substantially in axial direction of the transfer drum and being disposed to travel in a direction opposite the rotary direction of the transfer drum during the rotary movement of the rotary suckers.

In accordance with an additional feature of the invention the suction orifices in the suction surfaces of the respective rotary suckers are offset eccentrically substantially in axially outward direction, as viewed from the middle of the transfer drum, and are rotatable in a direction opposite to the rotary direction of the transfer drum as suction is applied to the trailing edge portion of the sheet through the suction orifices.

In accordance with yet another feature of the invention and in order to attain a good tensioning effect when processing sheets of relatively thick material, an eccentrically offset suction head carried by the rotary suckers, respectively, and a suction collar of resilient material carried by the suction head are provided. More specifically according to the invention, the resilient material of the suction collar is rubber. The provision of the rubber section collar affords the considerable advantage that even cardboard with a rough surface can be reliably sucked by the suckers. The advantage of the rotary sucker is partly that, due to the rotation of the suction surface during the tensioning movement, a rotary sliding movement between the suction collar and the sheet is executed. This prevents the lip of the sleeve from bending or folding over. Furthermore, such rotary suckers operate with considerably reduced suction air consumption.

In accordance with an additional feature of the invention, the eccentricity by which the suction orifices are offset increases for the respective suction orifices in substantially axial outward direction as viewed from the middle of the transfer drum.

In accordance with an added feature of the invention, an eccentrically offset suction head is carried by the rotary suckers, respectively, the eccentricity by which the suction heads carried by the respective rotary suckers are offset increasing in substantially axial outward direction as viewed from the middle of the transfer drum.

In accordance with a further feature of the invention, the suction orifices have an angular position with respect to the rotary axis of the respective rotary suckers that is adjustable in accordance with the tensioning direction and with the tensioning travel distance of the suction orifices. Thereby, the tensioning travel distance from the inside toward the outside can be increased and the longitudinal tensioning travel distance can remain the same.

In accordance with another feature of the invention, the control means comprises an axial cam, and a thrust rod cooperates with the axial cam and is movable in accordance with the cam track thereof to rotate the rotary suckers.

In accordance with yet another feature of the invention, the thrust rod and the respective rotary suckers have a pin-and-slot connection for converting rectilinear motion of the thrust rod into rotary motion of the rotary suckers.

In accordance with a concomitant feature of the invention, the thrust rod is controllable by the axial cam so that the pin-and-slot connection is located alternately at one and the other side of the rotary axis of the respective rotary suckers whereby the rotary suckers are alternately rotatable in one and the other rotary direction.

In accordance with another feature of the invention, the pin of the pin-and-slot connection extends from the rotary sucker, and the slot of the pin-and-slot connection is formed in and extends transversely to the thrust rod, the pin being received in the slot.

In accordance with a further feature of the invention, the control means further includes a cam follower in the form of a roller carried by the thrust rod and engageable with the axial cam, the roller being rotatable about an eccentric pin, and scale means carried by the eccentric pin for adjusting the angular position of the roller with respect to the axial cam.

In accordance with an added feature of the invention, stop screw means are provided for limiting the length of travel of the thrust rod. When the printing press is set in the mode for printing on only a single side of a sheet and is also capable for printing on both sides of a sheet i.e. perfector printing, and it is therefore designed not to execute any control movement, bolt means are provided in accordance with another feature of the invention, for arresting the movement of the thrust rod relative to the rotary suckers.

To accommodate the particular paper that is to be processed, respectively, in accordance with a further feature of the invention, the assembly includes suction tube means connected to the suction orifice means for supplying suction thereto, and slider means adjustable to open and to close off the supply of suction from the suction tube to the suction orifice means for regulating the strength of the supplied suction.

Other features which are considered as characteristic for the invention are set forth in the appended claims. Although the invention is illustrated and described herein as embodied in a transfer drum in sheet-fed rotary printing presses, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

FIG. 6 is a diagrammatic view corresponding to that of FIG. 4 and showing the rotary suckers of the suction device in position for tensioning a sheet;

FIG. 7 is a diagrammatic view of the thrust rod of the invention in a position to that of the rotary suckers in FIG. 6; FIG. 8 is a diagrammatic view of two of the rotary suckers in position for longitudinal tensioning;

FIG. 9 is a diagrammatic view of two of the rotary suckers in position for longitudinal tensioning;

FIG. 10 is a fragmentary enlarged view of FIG. 1 showing modified rotary suckers having eccentric suction heads;

Figure 1:
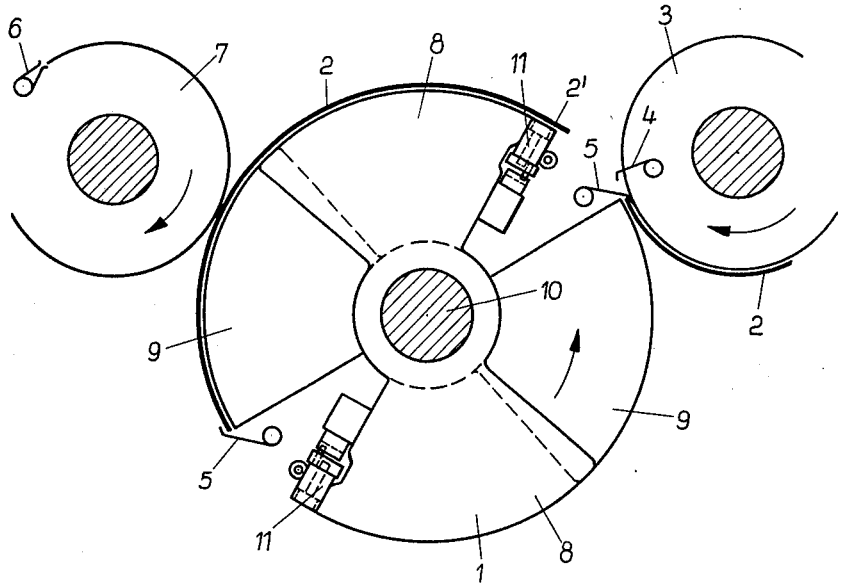
FIG. 1 is a side elevational view of the transfer drum of the invention carrying a sheet.
Figure 2:
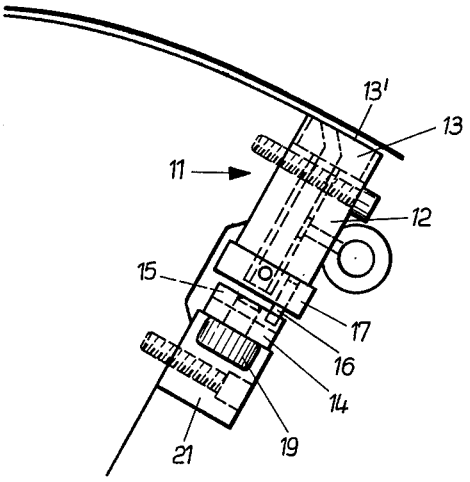
FIG. 2 is an enlarged fragmentary view of FIG. 1 showing a suction device which forms part of the invention.

Referring now to the drawing and first particularly to FIGS. 1 and 2 thereof there is shown, in an exemplary embodiment of the invention, a transfer or storage drum 1 to which sheets 2 are fed by a delivery drum 3, the transfer drum 1 being twice the diameter of that of the delivery drum 3. In a conventional manner, grippers 4 of the delivery drum 3 surrender the sheet 2 to grippers 5 of conventional construction that are located in channels suitably provided in the transfer drum 1. For imprinting a single side of a sheet 2, after the latter has been imprinted on one side by a preceding printing unit i.e. a printing unit located to the right-hand side of FIG. 1, the sheet 2 delivered by the delivery drum 3 is surrendered by the transfer drum 1 and the grippers 5 to grippers 6 of a sheet turning or turnover drum 7. For imprinting both front and back of a sheet i.e. perfector printing, the sheet end is taken over or accepted by the grippers 6 and is fed in turned-over position to the next printing unit located to the lefthand side of FIG. 1.

The transfer drum 1 is formed of segments 8 and 9 which are pivotable relative to one another about a drum shaft 10. The peripheral length of the outer surface of the transfer drum 1 is adjustable in conformity with the particular sheet format to be handled. The trailing edge 2' of the sheet 2 is gripped by a suction device 11 which is formed with a bracket or holder 12 extending along the width of the transfer drum 1 and mounted in the aforementioned channel formed in the transfer drum 1. The suction device holder 11 is fixed to the segment 8 at the end of the respective peripheral sheet supporting surface thereof. A plurality of rotary suckers 13 (FIGS. 2, 3 and 4), constructed in accordance with the invention, extend in radial direction of the transfer drum 1 along the length of the bracket or holder 12. A thrust rod 14 formed with transverse grooves 15 (FIGS. 2, 3 and 4) serves to rotate the rotary suckers 13. Crank pins 16 respectively engage in the transverse grooves 15 and are fixed by a clamping ring 17 to the rotary suckers 13. Upon axial displacement of the thrust rod 14, each rotary sucker 13 accordingly experiences corresponding rotary movement through the crank pins 16.

Figure 3:
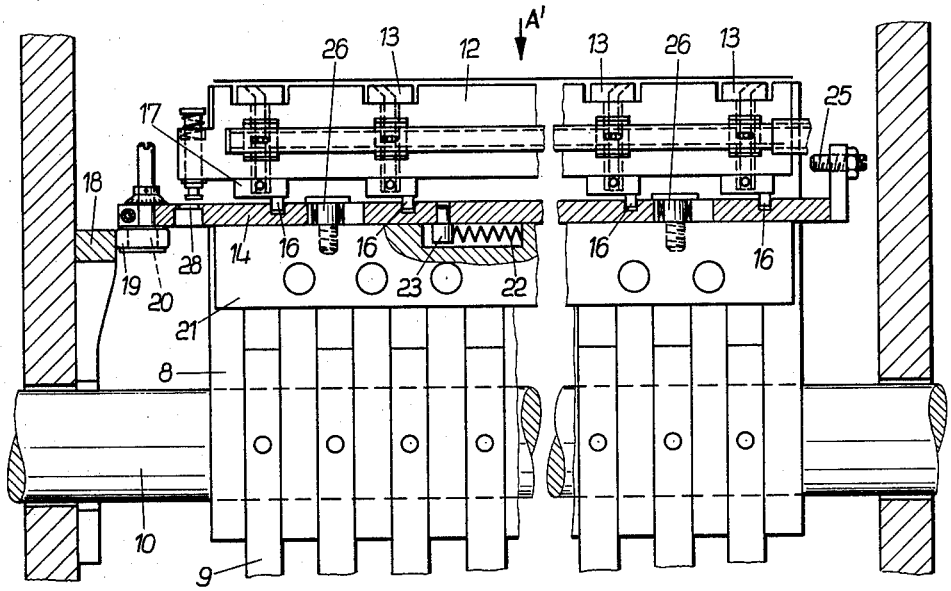
FIG. 3 is a partly broken-away, longitudinal view of the transfer drum of FIG. 1.

As shown in FIG. 3, the thrust rod 14 is displaced axially on the guide rail 21 by the axial cam 18 through the intermediary of a cam follower or roller 19 and an eccentric pin 20. A compression spring 22, which produces contact pressure for the cam follower 19 through the bolt 23, is disposed in the guide rail 21.

Figure 4:
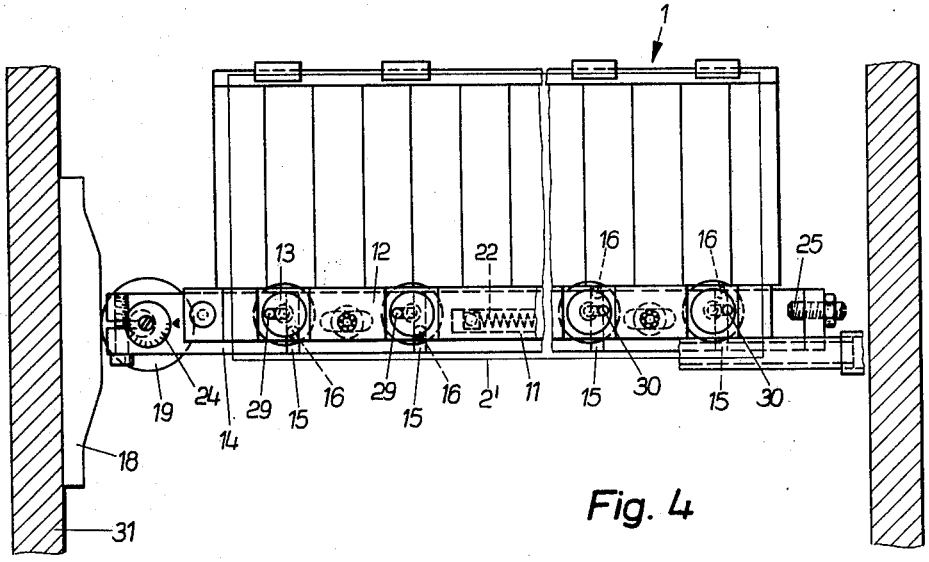
FIG. 4 is a top plan view of FIG. 3.

The range of the stroke or thrust distance of the thrust rod 14 is adjustable through the eccentric pin 20 and can be read off a scale 24 (FIG. 4).

Figure 5:
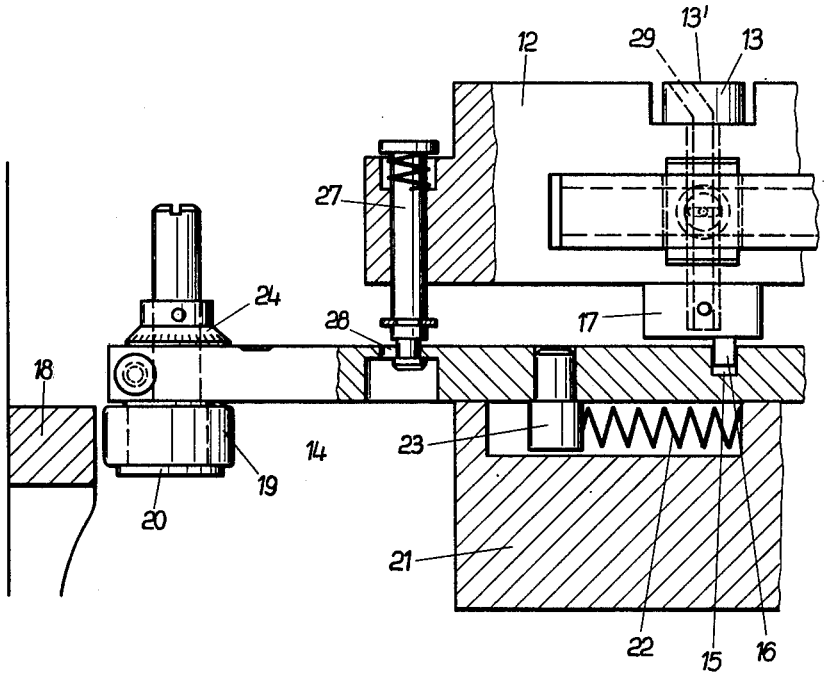
FIG. 5 is an enlarged fragmentary view of FIG. 3 showing the suction device with control means.

The length of stroke or thrust distance can also be limited by the stop screw 25, so that the cam follower 19 lifts off the cam 18. The thrust rod 14 is thereby guided during the thrust motion thereof by guide bolts 26. By pressing the locking bolt 27 (note FIG. 5, especially) into the holding bore 28 of the thrust rod 14, the movement of the latter can be halted. FIG. 5 thus shows the thrust rod 14 in the halted position thereof wherein the cam follower 19 is lifted from the axial cam 18.

The suction orifices 29 and 30 in the suction surfaces 13' of the rotary suckers 13 are staggered or offset eccentrically with respect to the center of rotation of the respective rotary sucker 13 in the axial direction of the transverse drum 1. In the embodiment shown in FIG. 4, the suction orifices, as viewed from the middle of the transfer drum 1, are offset or staggered outwardly so that the suction orifices 29 point to the left-hand side of the transfer drum 1, as viewed in FIG. 4, and the suction orifices 30 to the right-hand side thereof.

When the axial cam 18, which is secured to a lateral frame 31, produces a control movement, the latter is transmitted through the transverse grooves 15 formed in the thrust rod 14 and through the crank pins 16 as rotary motion to the rotary suckers 13. During the working stroke i.e. during the clamping or tensioning of the trailing edge 2' of the sheet 2, the cam follower 19 is lifted from the axial cam 18 so that the suction orifices 29 and 30 rotate in a direction opposite to the direction of rotation of the transfer drum 1. Consequently, in the plan view of FIG. 4, the rotary suckers on the left-hand half of the figure perform a counterclockwise rotary motion with the suction orifices 29 thereof, whereas the rotary suckers on the right-hand half of FIG. 4 with the suction orifices 30 thereof rotate clockwise. In this case the direction of rotation of the surface of the transfer drum 1 as viewed in FIG. 4 is upwardly.

The operating principle of the aforedescribed embodiment of the invention is illustrated more clearly in FIGS. 6 and 7, of which FIG. 6 shows the direction of movement of the rotary suckers 13 and FIG. 7 the operating principle of the thrust rod 14 in conjunction with the crank pins 16. The movement of the individual components of the illustrated embodiment of the invention occurs, respectively, from the position thereof shown in lighter lines to the position thereof shown in darker lines. Both of FIGS. 6 and 7 diagrammatically represent the same motion cycle. The direction of the arrow A indicates the adjusted direction of tensioning for the trailing edge 2' of the sheet 2, which is shown without tension in the position represented by broken lines i.e. in phantom, and is shown in tension in the position represented by solid lines in FIG. 6.

By turning the eccentric pin 20, the transverse grooves 15 in the thrust rod 14 can be displaced with respect to the middle of the rotary suckers 13. The range of rotation of the suction orifices 29 and 30 is thereby varied or modified. FIG. 8 shows the suction orifices 29 and 30 having a modified range of rotation as compared to that of FIG. 6, the tensioning force in the direction of the arrows $A_1$ in FIG. 8 acting more outwardly and thus tensioning the sheet 2 more strongly transversely to the direction of travel.

In FIG. 9, the range of rotation of the suction orifices 29 and 30 is limited by the stop screw 25 (FIG. 7). In the case of this adjustment, only a short tensioning travel is transmitted to the trailing end 2' of the sheet 2 and acts in direction of the arrows $A_2$.

In accordance with the embodiment of FIG. 10, the rotary sucker 13 carries an eccentrically offset suction head 32 which is provided with receiving grooves 33 for a rubber suction collar 34. With the later, it is possible to exert adequately powerful suction force even in the case of a rough paper surface, the tensioning force to be transmitted being increasable by the eccentrically offset suction head 32.

Figure 11:
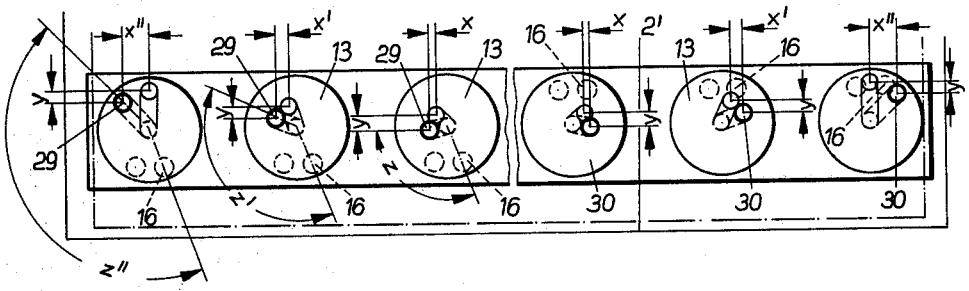
FIG. 11 is a diagrammatic view of another embodiment of the rotary suckers wherein they have increasing eccentricity of the respective suction orifices thereof.
Figure 12:
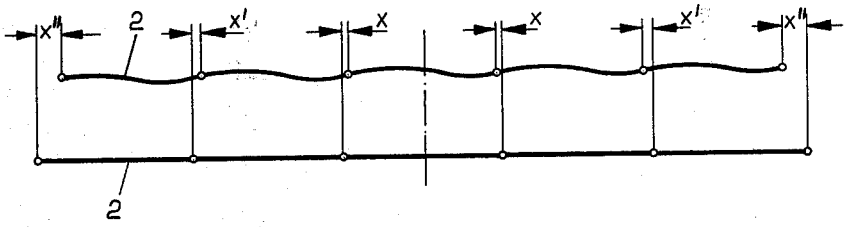
FIG. 12 is a tensioning diagram of a sheet before and after tensioning.

With the rotary suckers 13 shown in FIG. 11, additional sheet expansion or stretching ought to be counteracted by lengthy slipping or sliding distances covered by the suckers 13 beneath the sheet, each of the suckers 13, as viewed from the middle of the transfer drum 1, respectively traveling over a longer tensioning distance outwardly transversely to the direction of travel of the sheet, while the tensioning distance, as viewed in the direction of travel of the sheet 2, remains the same. This is accomplished due to the fact that the eccentricity of the suction orifices 29 and 30 increases from the inside toward the outside, while the suction orifices 29 and 30 are adjusted at a larger angle $z$, $z'$, $z''$, with respect to the crank pin 16. The distance $x$ thereby changes to $x'$ and $x''$, whereas the tensioning value $y$ remains constant. FIG. 12 shows how the sheet 2, having a marked wave shape in direction of transfer thereof, is subjected to tension uniformly by the different tensioning distance $x$, $x'$ and $x''$, as viewed outwardly from the middle.

Figure 13:
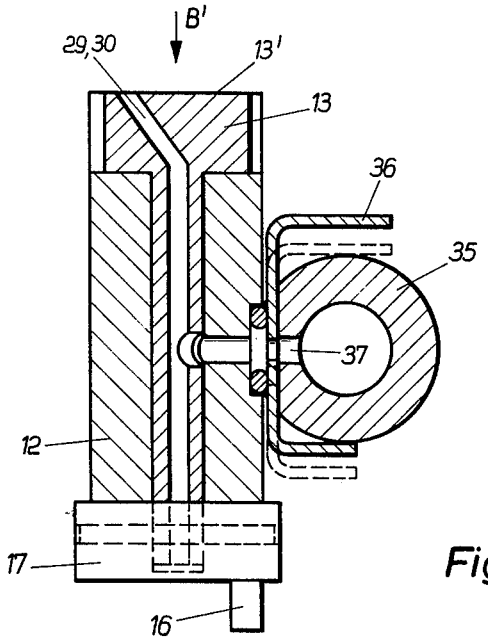
FIG. 13 is a fragmentary enlarged sectional view of FIG. 2 showing the support means for the suction device.
Figure 14:
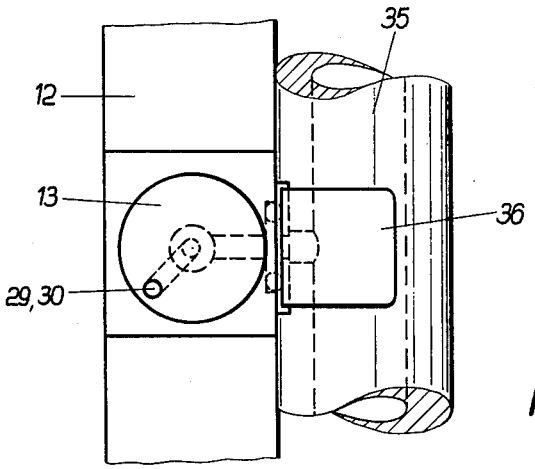
FIG. 14 is a top plan view of FIG. 13 in direction of the arrow B′.

The cross-sectional view of the bracket 12 and the rotary suckers 13 according to FIG. 13 shows the disposition of a suction tube 35 and a slide valve 36 with respect thereto. The slide valve 36 is separately adjustable for each rotary sucker 13 and thereby affords regulation of the air suction by suitably uncovering the suction orifice 37. The suction air for the respective rotary sucker 13 can also be shut off with the slide valve 36.

The control motion of the rotary suckers 13 can take place virtually along the entire travel distance which the trailing edge 2' of the sheet 2 traverses during he rotation of the transfer or storage drum 1 between the delivery drum 3 and the sheet turning or turn-over drum 7. Due to this lengthy time period, a gentle tensioning of the sheet occurs, so that it is possible to process even heavy or difficult papers.

As mentioned hereinbefore, the invention is not limited to the embodiment illustrated in the drawings. Instead of the rotary suckers 13, other similar devices may also be employed such as suction sliders, for example, which are slideable in slots formed on a bar, the slots being disposed transversely to the desired tensioning direction or formed so as to be adjustable accordingly.

There is claimed:

1. In a sheet-fed rotary printing press, a transfer drum assembly comprising a rotatable transfer drum formed with a sheet-supporting peripheral surface having at least two ends circumferentially spaced about; said transfer drum, a gripper device carried by said transfer drum for gripping the leading edge portion of a sheet being transferred, and a suction device secured to said transfer drum at one of said ends of said peripheral sheet-supporting surface for gripping the trailing edge portion of the sheet, said suction device comprising a plurality of suckers having movable suction surfaces disposed in the peripheral surface of said transfer drum , said suction surfaces being formed with suction orifices located therein, means for simultaneously moving each of said suction orifices in both an axial and circumferential direction relative to said peripheral surface so that a suction force applied through said orifices at the varying positions thereof simultaneously tensions the sheet in an axial and circumferential direction relative to said peripheral surface.

2. Transfer drum assembly according to claim 1 wherein said transfer drum has respective opposite end faces and a middle point therebetween located on the rotary axis of said drum, and wherein said suction orifices are successively moved axially toward the end faces of said transfer drum as viewed from said middle point and in a circumferential direction toward the location at which the trailing edge of the sheet is disposed on said peripheral sheet-supporting surface.

3. Transfer drum assembly according to claim 1 including suction tube means connected to said suction device for supplying suction thereto, and slider means adjustable to open and to close off the supply of suction from said suction tube means to said suction device and for regulating the strength of the supplied suction.

4. Transfer drum assembly according to claim 1 wherein said suckers are rotary suckers, and said suction orifices are movable to varying positions during rotation of the respective rotary suckers.

5. Transfer drum assembly according to claim 4 wherein said transfer drum has respective opposite end faces and a middle point therebetween located on the rotary axis of said drum and wherein said suction orifices formed in the suction surfaces of the respective rotary suckers are offset eccentrically substantially in axial direction toward the end faces of said transfer drum, as viewed from said middle point, and are rotatable in a direction opposite to the rotary direction of said transfer drum as suction is applied to the trailing edge portion of the sheet through said suction orifices.

6. Transfer drum assembly according to claim 5 wherein the eccentricity by which said suction orifices are offset increases for the respective suction orifices in substantially axial direction toward the end faces of said transfer drum as viewed from the middle of said transfer drum.

7. Transfer drum assembly according to claim 6 including an eccentrically offset suction head carried by said rotary suckers, respectively, the eccentricity by which the suction heads carried by the respective rotary suckers are offset increasing in substantially axial direction toward the end faces of said transfer drum as viewed from the middle of said transfer drum.

8. Transfer drum assembly according to claim 4 including an eccentrically offset suction head carried by said rotary suckers, respectively, and a suction collar of resilient material carried by said suction head.

9. Transfer drum assembly according to claim 8 wherein the resilient material of said suction collar is rubber.

10. Transfer drum assembly according to claim 4 including means for holding said rotary suckers extending across the width of said transfer drum, control means for imparting rotary movement to said rotary suckers, said suction orifices being offset eccentrically substantially in axial direction of said transfer drum and being disposed to travel in a direction opposite the rotary direction of said transfer drum during the rotary movement of said rotary suckers.

11. Transfer drum assembly according to claim 10 wherein said control means comprise an axial cam, and a thrust rod cooperating with said axial cam and movable in accordance with the cam track thereof to rotate said rotary suckers.

12. Transfer drum assembly according to claim 11 wherein said thrust rod and the respective rotary suckers have a pin-and-slot connection for converting rectilinear motion of said thrust rod into rotary motion of said rotary suckers.

13. Transfer drum assembly according to claim 12 wherein said thrust rod is controllable by said axial cam so that said pin-and-slot connection is located alternately at one and the other side of the rotary axis of the respective rotary suckers whereby said rotary suckers are alternately rotatable in one and the other rotary direction.

14. Transfer drum assembly according to claim 12 wherein the pin of said pin-and-slot connection extends from said rotary sucker, and the slot of said pin-and-slot connection is formed in and extends transversely to said thrust rod, said pin being received in said slot.

15. Transfer drum assembly according to claim 11, wherein said control means further include a cam follower in the form of a roller carried by said thrust rod and engageable with said axial cam, said roller being rotatable about an eccentric pin, and scale means carried by said eccentric pin for adjusting the angular position of said roller with respect to said axial cam.

16. Transfer drum assembly according to claim 15, including stop screw means for limiting the length of travel of said thrust rod.

17. Transfer drum assembly according to claim 11 including bolt means for arresting the movement of said thrust rod relative to said rotary suckers.

18. Transfer drum assembly according to claim 4 wherein said suction orifices have an angular position with respect to the rotary axis of the respective rotary suckers that is adjustable in accordance with said tensioning direction and with the tensioning travel distance of said suction orifices.

* * * * *